United States Patent [19]

Blanchard

[11] 4,371,348

[45] Feb. 1, 1983

[54] MOUNTING FOR MARINE PROPULSION DEVICE LOCATED AFT OF BOAT TRANSOM

[75] Inventor: Clarence E. Blanchard, Kenosha, Wis.

[73] Assignee: Outboard Marine Corporation, Waukegan, Ill.

[21] Appl. No.: 188,323

[22] Filed: Sep. 18, 1980

[51] Int. Cl.[3] ..... B63H 5/12; B63H 21/26

[52] U.S. Cl. ..... 440/52; 440/58; 440/77; 440/78; 440/88

[58] Field of Search ..... 440/49, 52, 53, 54, 440/55, 58, 61, 62, 63, 64, 65, 76, 77, 78, 83, 88, 89, 112

[56] References Cited

U.S. PATENT DOCUMENTS

| | | | |
|---|---|---|---|
| 1,511,867 | 5/1925 | Asbury | 440/55 |
| 2,235,140 | 3/1941 | Clarke . | |
| 2,688,299 | 9/1954 | Gload et al. | 440/58 |
| 3,006,311 | 10/1961 | Hansson | 440/63 |
| 3,083,678 | 4/1963 | Leipert | 440/52 |
| 3,171,382 | 3/1965 | Bergstedt | 440/53 |
| 3,269,350 | 8/1966 | Stibbe et al. | 440/53 |
| 3,382,838 | 5/1968 | Bergstedt | 440/75 |
| 3,487,804 | 1/1970 | Kiekhaefer | 440/56 |
| 3,847,108 | 11/1974 | Shimanckas | 440/57 |
| 3,968,767 | 7/1976 | Blanchard | 440/89 |
| 3,982,496 | 9/1976 | Blanchard | 440/52 |
| 4,040,378 | 8/1977 | Blanchard | 440/112 |

FOREIGN PATENT DOCUMENTS

| | | | |
|---|---|---|---|
| 660507 | 2/1964 | Italy | 440/65 |

*Primary Examiner*—Sherman D. Basinger

*Attorney, Agent, or Firm*—Michael, Best & Friedrich

[57] ABSTRACT

Disclosed herein is a marine propulsion device comprising a bracket adapted to be fixed relative to the transom of a boat and including an opening extending generally horizontally when the bracket is boat mounted, a marine propulsion unit including a fixed assembly extending through the opening, fixed relative to the bracket, and including a power head located above the bracket and including an internal combustion engine, and an upper housing located below the bracket and fixed to the power head. The propulsion unit also includes a lower housing connected to the upper housing for pivotal movement therebetween about a tilt axis which is horizontal when the bracket is boat mounted, a gear case assembly connected to the lower housing for pivotal movement therebetween about a steering axis which is transverse to the tilt axis, a propeller rotatably carried by the gear case assembly, and a drive train connected to the propeller and the engine and extending through the gear case assembly and the lower and upper housings.

14 Claims, 2 Drawing Figures

MOUNTING FOR MARINE PROPULSION DEVICE LOCATED AFT OF BOAT TRANSOM

BACKGROUND OF THE INVENTION

The invention relates generally to marine propulsion devices, and more particularly, to marine propulsion devices having a gear case assembly which is both tiltable and steerable. Still more particularly, the invention relates to marine propulsion devices which include a stationarily mounted power head, together with a gear case assembly which is both steerable and tiltable relative to the power head.

Attention is directed to the U.S. Leipert Pat. No. 3,083,678 which discloses a marine propulsion device including a stationarily mounted power head and a steerable and tiltable gear case assembly.

Attention is also directed to the U.S. Blanchard Pat. Nos. 3,982,496 issued Sept. 28, 1976, 3,968,767 issued July 13, 1976 and 4,040,378 issued Aug. 9, 1977, which disclose arrangements for mounting marine propulsion devices through the bottom of a boat hull.

Attention is also directed to the U.S. Kiekhaefer Pat. No. 3,487,804 issued Jan. 6, 1970, which discloses a stern drive unit including an air duct for delivering air into the slip stream of a propeller.

Attention is also directed to the U.S. Shimanckas Pat. No. 3,847,108 issued Nov. 12, 1974, which discloses a stern drive unit.

SUMMARY OF THE INVENTION

The invention provides a marine propulsion device comprising a bracket adapted to be fixed relative to the transom of a boat, which bracket includes an opening extending generally horizontally when the bracket is boat mounted, a marine propulsion unit including a fixed assembly extending through the opening, fixed relative to the bracket, and comprising a power head located above the bracket and including an internal combustion engine, and an upper housing located below the bracket, a lower housing connected to the upper housing for pivotal movement therebetween about a tilt axis which is horizontal when the bracket is boat mounted, a gear case assembly connected to the lower housing for pivotal movement therebetween about a steering axis which is transverse to the tilt axis, a propeller rotatably carried by the gear case assembly, and a drive train connected to the propeller and to the engine and extending through the gear case assembly and the lower and upper housings.

In one embodiment of the invention, the marine propulsion device also includes elastomeric mounting means interposed the bracket and the fixed assembly.

In one embodiment of the invention, the bracket includes a mounting portion including the opening and the opening is defined, at least in part, by an upwardly and outwardly extending upper conical surface and a downwardly and outwardly extending lower conical surface. In addition, the upper housing includes, at the upper end thereof, a downwardly and outwardly extending conical surface, and the power head includes, at the lower end thereof, an upwardly and outwardly extending conical surface. Still further in addition, there is provided a first elastomeric mounting ring located between the conical surface of the power head and the upper conical surface of the bracket, a second elastomeric mounting ring located between the conical surface of the upper housing and the lower conical surface of the bracket, and means located inwardly of the opening for connecting together the power head and the upper housing with the mounting portion of the bracket captured therebetween.

In one embodiment of the invention, the marine propulsion device further includes a cover cooperating with the bracket to define a substantially sealed compartment enclosing the power head.

In one embodiment of the invention, the cover includes a top wall having front, rear and side margins, and front, rear and side walls extending downwardly respectively from the front, rear and side margins of the top wall, and the marine propulsion device further includes means sealingly connecting the cover to the transom bracket to prevent entry therebetween of water.

In one embodiment of the invention, the marine propulsion device further includes duct means extending through the boat transom and communicating with the interior of the compartment for supplying air to the power head from forwardly of the boat transom.

In one embodiment of the invention, the marine propulsion device further includes propulsion unit control means extending through the duct into the compartment and connected to the propulsion unit for control thereof.

The invention also provides a marine propulsion installation comprising a boat hull including a transom, a propulsion device including a power head compartment which is located aft of the transom, which has an interior housing an internal combustion engine, and which is substantially closed, means connecting the propulsion device to the transom, and a duct extending through the transom and communicating between the atmosphere forwardly of the transom and the interior of the power head compartment.

The invention also provides a marine propulsion installation comprising a boat hull including a transom having therein an aperture, a propulsion unit including a power head compartment which is located aft of the transom, which has an interior housing an internal combustion engine, which is substantially closed, and which includes a forwardly located wall having therein an aperture, means connecting the propulsion unit to the transom, and a duct sealingly connected to the transom and to the forwardly located wall and including a hollow interior in communication through the opening in the transom with the atmosphere forwardly of the transom and communicating through the aperture in the forwardly located wall with the interior of the power head compartment.

Other features and advantages of the embodiments of the invention will become known by reference to the following general description, claims and appended drawings.

IN THE DRAWINGS

Figure 1:
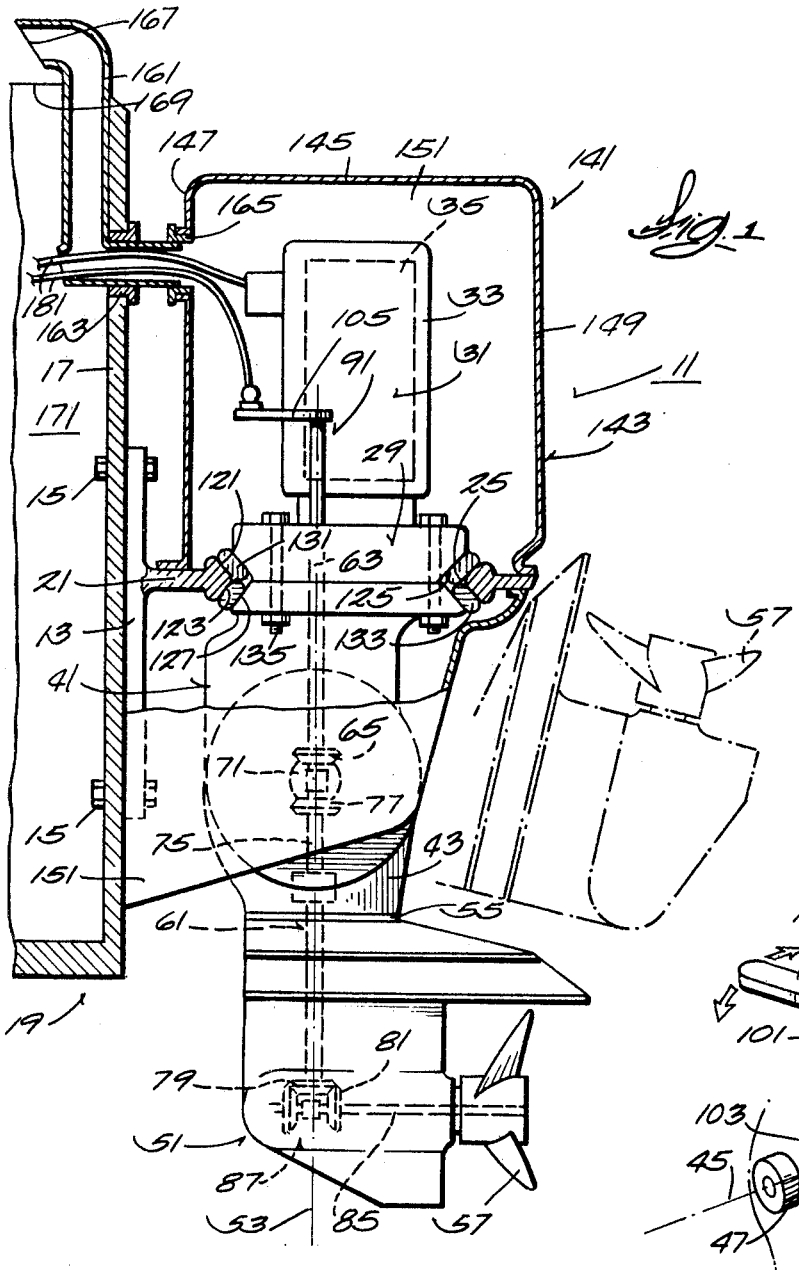
FIG. 1 is a partially schematic, and partially sectioned, side elevational view of a marine propulsion device embodying various of the features of the invention.
Figure 2:
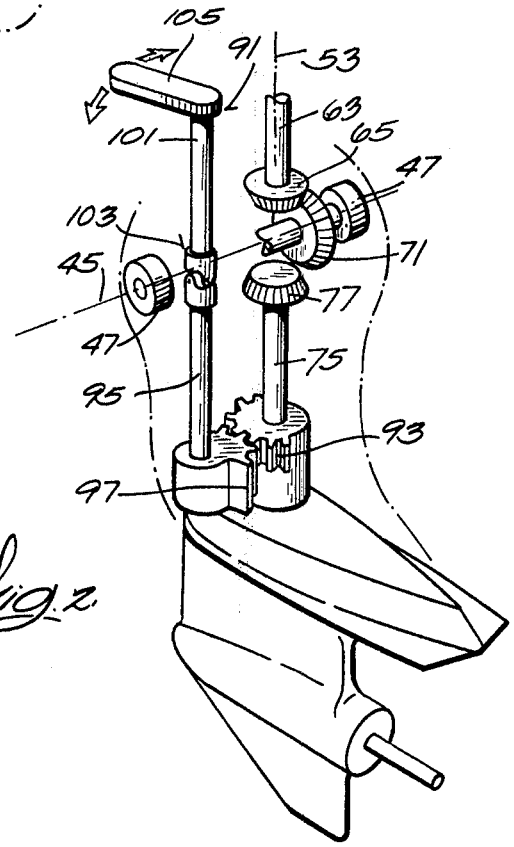
FIG. 2 is a fragmentary, schematic view of various of the components of the marine propulsion device shown in FIG. 1.

Before explaining one embodiment of the invention in detail it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown partially schematically in the drawings is a marine propulsion device 11 including a transom bracket 13 which is adapted to be fixed by any suitable means, such as by bolts 15, to the transom 17 of a boat hull 19. The bracket 13 includes a mounting portion 21 which extends rearwardly, which is generally horizontal when the bracket 13 is boat mounted, and which includes an opening 25 which is preferably circular.

Extending through the opening 25 is a fixed part or assembly 29 of a marine propulsion unit 31, which fixed part or assembly 29 is connected to the transom bracket 13 as will be explained hereinafter, and includes a power head 33 located above the mounting portion 21 of the transom bracket 13 and including an internal combustion engine 35, together with an upper housing 41 which is suitably connected, as will be explained hereinafter, through the opening 25 with the power head 33 and which is located below the mounting portion 21 of the transom bracket 13.

The propulsion unit 31 also includes a lower housing 43 which is connected to the upper housing 41 by any suitable means providing for pivotal movement of the lower housing 43 relative to the upper housing 41 about a horizontal tilt axis 45. In the disclosed construction, such means comprises a pair of trunions or bearings 47 which are shown schematically and spaced axially of the tilt axis 45.

The propulsion unit 31 also includes a gear case assembly 51 which is connected to the bottom of the lower housing 43 by any suitable means providing pivotal movement in the vertical plane in common with the lower housing 43 and pivotal movement of the gear case assembly 51 relative to the lower housing 43 about a steering axis 53 which is tranverse to and radially intersects the tilt axis 45. In the disclosed construction, such means comprises a schematically shown bearing means 55.

Any suitable hydraulic or other means or mechanism (not shown) can be employed for tiltably displacing the lower housing 43 and connected gear case assembly 51 relative to the upper housing 41. Such mechanism can also be adapted for absorbing energy while permitting up-tilting of the gear case assembly 51 in response to the striking of an underwater obstacle by the gear case assembly 51.

The gear case assembly 51 rotatably supports a propeller 57 which is driven by the engine 35 through a drive train 61 which extends through the gear case assembly 51, and through the lower and upper housings 41 and 43, and which is drivingly connected to the engine 35.

More specifically, the drive train 61 includes an upper drive shaft 63 which is supported for rotation about a vertical axis extending radially from the tilt axis 45 by the upper housing 41 and which is drivingly connected to the engine 35. At its lower end, the upper drive shaft includes a bevel gear 65.

The drive train 61 also includes a transfer bevel gear 71 which is supported by any suitable means mounted in the upper housing 41 for rotation about an axis coincident with the tilt axis 45 and in mesh with the bevel gear 65 at the bottom of the upper drive shaft 63.

The drive train 61 also includes a lower drive shaft 75 which is supported by any suitable means mounted in the lower housing 43 for rotation about an axis coincident with the steering axis 53 and extending radially from the tilt axis 45. At its upper end, the lower drive shaft 75 has mounted thereon a bevel gear 77 in mesh with the transfer bevel gear 71.

The lower drive shaft 75 extends into the gear case assembly 51, can be rotatably supported thereby, and includes, at the lower end thereof, a bevel gear 79 which is in mesh with a bevel gear 81 mounted on a propeller shaft 85 which is rotatably supported in the gear case assembly 51 and which has fixed thereon the propeller 57. Accordingly, the drive train is designed to accommodate both tilting and steering of the gear case assembly 51 without interruption of the delivery of power through the drive train 61 to the propeller 57.

The drive train 61 can also include a reversing transmission 87 located in the gear case assembly 51 and operated either by hydraulic, electrical, or mechanical means. Any suitable reversing transmission can be employed. Alternatively, if desired, a suitable reversing transmission can be located in the upper housing 41 between the upper drive shaft 63 and the engine 35. Any suitable transmission can be employed.

The gear case assembly 51 is pivotally displaceable about the steering axis 53, notwithstanding tilting thereof with the lower housing 43, by a steering mechanism 91 including a gear segment 94 which is fixed to the gear case assembly 51 and which has a center or axis coincident with the steering axis 53.

The steering mechanism 91 also includes a lower steering shaft 95 which is rotatably supported in the lower housing 43 by any suitable means in radially extending relation from the tilt axis 45 and in spaced relation axially of the tilt axis 45 from the drive train 61. At its lower end, the lower steering shaft 95 has fixed thereon a pinion 97 in meshing engagement with the steering gear segment 93 so that rotation of the lower steering shaft 95 causes steering movement of the gear case assembly 51 relative to the lower housing 43.

The steering mechanism 51 also includes an upper steering shaft 101 which is rotatably supported in the upper housing 41 by any suitable means in radially extending relation from the tilt axis 45. At its lower end, the upper steering shaft 101 is connected to a universal coupling 103 which extends across the tilt axis 45 and is connected to the upper end of the lower steering shaft 95 to effect rotation of the lower steering shaft 95 in response to rotation of the upper steering shaft 101 notwithstanding tilting of the lower housing 43 relative to the upper housing 41.

At its upper end, the upper steering shaft 101 passes through the opening 25 into the power head 33 and has connected thereto a steering arm or lever 105 which can be pivotally displaced about the axis of the upper steering shaft 101 so as to rotate the upper steering shaft 101 by any suitable means such as for instance, the hydraulic arrangement disclosed in U.S. application Ser. No. 173,158, filed July 28, 1980. Thus, pivoting of the steering arm or lever 105 causes related pivotal steering movement of the gear case assembly 51 relative to the lower housing 43.

Referring again to the mounting of the propulsion unit 31 by the transom bracket 13, the opening 25 in the mounting portion 21 of the transom bracket 13 is preferably circular and is defined, at least in part, by formation of the mounting portion 21 with an upwardly and outwardly flaring upper conical surface 121 and a downwardly and outwardly flaring lower conical surface 123. In addition, the power head 33 is provided, at its bottom, with an upwardly and outwardly flaring conical surface 125 adapted generally to mate with the upper conical surface 121 of the transom bracket mounting portion 21, and the upper end of the upper housing 41 is provided with an outwardly and downwardly flaring conical surface 127 adapted generally to mate with the lower conical surface 123 of the transom bracket mounting portion 21.

In order to vibrationally isolate the propulsion unit 31 from the transom bracket 13, while fixedly connecting the propulsion unit 31 to the transom bracket 13, there is interposed, between the conical surface 125 of the power head 33 and the upper conical surface 121 of the transom bracket 13, an elastomeric mounting ring 131. A similar elastomeric mounting ring 133 is interposed between the conical surface 127 of the upper housing 41 and the lower conical surface 123 of the transom bracket 13.

The power head 33 and the upper housing 41 are assembled together and to the transom bracket 13 by a plurality of bolts 135 which extend through the transom bracket opening 25 and between the upper housing 41 and power head 33 so as to capture the mounting rings 131 and 133 between the conical surfaces 121, 123, 125 and 127 and thereby to retain stationary the fixed assembly 29 of the power head 33 and upper housing 41 with respect to the transom bracket 13, while at the same time, vibrationally isolating the propulsion unit 31 from the transom bracket 13, and preventing passage of water between propulsion unit 31 and the transom bracket 13.

Means are also provided for enclosing the power head 33 in a water-tight compartment 141. While various constructions can be employed, in the illustrated construction, there is provided, in addition to the mounting rings 131 and 133, a cover 143 including a top wall 145 having peripheral margins, together with front, rear and side walls 147, 149 and 151, respectively extending downwardly from the top wall margins. The cover 143 is sealingly and removably connected to the mounting portion 21 of the transom bracket 13 outwardly of the opening 25. Any suitable sealing and clamping means can be employed for releasably and sealingly connecting the cover 143 to the transom bracket 13 so as to exclude water.

Alternatively, if desired, the transom bracket 13 could extend so as to provide all, or part of, one or more, of the front, rear, side, and top walls and to cooperate with a removable cover section of lesser extent than the cover 143.

The transom bracket 13 can also include, to each side of the upper housing 41, respective shields 151 which extend downwardly from the transom bracket mounting portion 21 and rearwardly from the boat transom 17. Of course, the shields 151 are unconnected to each other at the bottom and rear to permit travel of the lower housing 43 and connected gear case assembly 51 between the normal running position shown in full lines, and a range of tilt positions, one of which is shown in dotted outline.

Means are provided for supplying the otherwise substantially sealed engine compartment 141 with combustion air for the engine 35. While various arrangements can be employed, in the illustrated construction, such means comprises an air duct or conduit 161 which passes through the transom 17 and which communicates through the front wall 147 of the cover 141 with the interior of the engine compartment 141. Suitable seals 163 and 165 are respectively provided between the duct or conduit 161 and each of the transom 17 and front wall 147 of the power head cover 143 to maintain the watertight integrity of these components. Preferably, the duct 161 extends upwardly and forwardly of the transom 17 and includes a forwardly facing entry opening 167 at a level above the top edge 169 of the sides 171 of the boat hull 19.

If desired, the air duct 161 can also be employed as a passageway for entry into the sealed engine compartment 141 of flexible propulsion unit fuel supply and/or control means 181 such as fuel supply lines, electrical connections, a throttle connection, and hydraulic or other connections to one or more of the steering mechanism 51, the reversing transmission 87, and the mechanism (not shown) for tiltably displacing the lower housing 43 and connected gear case assembly 51 relative to the upper housing 41.

Various of the features of the invention are set forth in the following claims.

I claim:

1. A marine propulsion device comprising a bracket adapted to be fixed relative to the transom of a boat, said bracket including an opening extending generally horizontally when said bracket is boat mounted, and a marine propulsion unit including an assembly extending through said opening and being fixed relative to said bracket, said assembly comprising a power head located above said bracket and including an internal combustion engine, and an upper housing located below said bracket, said marine propulsion unit also including a lower housing connected to said upper housing for pivotal movement therebetween about a tilt axis which is horizontal when said bracket is boat mounted, a gear case assembly connected to said lower housing for pivotal movement therebetween about a steering axis which is transverse to said tilt axis, a propeller rotatably carried by said gear case assembly, and a drive train connected to said propeller and said engine and extending through said gear case assembly and said lower and upper housings.

2. A marine propulsion device in accordance with claim 1 and further including elastomeric mounting means interposed said bracket and said fixed assembly.

3. A marine propulsion device in accordance with claim 1 wherein said bracket includes a mounting portion including said opening, wherein said opening is defined, at least in part, by an upwardly and outwardly extending upper conical surface and a downwardly and outwardly extending lower conical surface, wherein said upper housing includes, at the upper end thereof, a downwardly and outwardly extending conical surface, wherein said power head includes, at the lower end thereof, an upwardly and outwardly extending conical surface, a first elastomeric mounting ring located between said conical surface of said power head and said upper conical surface of said bracket, a second elastomeric mounting ring located between said conical surface of said upper housing and said lower conical surface of said bracket, and means located inwardly of said opening for connecting together said power head and said upper housing with said mounting portion of said bracket captured therebetween.

4. A marine propulsion device in accordance with claim 1 and further including a cover cooperating with said bracket to define a substantially sealed compartment enclosing said power head.

5. A marine propulsion device in accordance with claim 4 wherein said cover includes a top wall having front, rear and side margins, and front, rear and side walls extending downwardly respectively from said front, rear and side margins of said top wall, and means sealingly connecting said cover to said transom bracket to prevent entry therebetween of water.

6. A marine propulsion device in accordance with claim 4 and further including duct means adapted to extend through the boat transom and communicating with the interior of said compartment for supplying air to said power head from forwardly of the boat transom.

7. A marine propulsion device in accordance with claim 6 wherein the boat includes a hull with sides having top edges and wherein said duct includes a forwardly facing inlet opening located forwardly of the transom and above the top edge of the sides of the hull.

8. A marine propulsion device comprising a bracket adapted to be fixed relative to the transom of a boat, said bracket including an opening extending generally horizontally when said bracket is boat mounted, a marine propulsion unit including a fixed assembly extending through said opening, fixed relative to said bracket, and comprising a power head located above said bracket and including an internal combustion engine, and an upper housing located below said bracket, a lower housing connected to said upper housing for pivotal movement therebetween about a tilt axis which is horizontal when said bracket is boat mounted, a gear case assembly connected to said lower housing for pivotal movement therebetween about a steering axis which is transverse to said tilt axis, a propeller rotatably carried by said gear case assembly, a drive train connected to said propeller and said engine and extending through said gear case assembly and said lower and upper housings, a cover cooperating with said bracket to define a substantially sealed compartment enclosing said power head, duct means adapted to extend through the boat transom and communicating with the interior of said compartment for supplying air to said power head from forwardly of the boat transom, and propulsion unit control means extending through said duct into said compartment and connected to said propulsion unit for control thereof.

9. A marine propulsion device in accordance with claim 1 wherein said drive train comprises an upper drive shaft connected to said engine and supported by said upper housing in radial relation to said tilt axis, a first bevel gear supported by and within said upper housing for rotation about said tilt axis, a second bevel gear fixed on said drive shaft and in mesh with said first bevel gear, a lower drive shaft having upper and lower ends, supported by said lower housing in radial relation to said tilt axis, and having an axis coincident with said steering axis, a third bevel gear fixed to said upper end of lower drive shaft and in mesh with said first bevel gear, a propeller shaft supported by said gear case assembly and carrying said propeller, a fourth bevel gear fixed to said lower end of said lower drive shaft, and a fifth bevel gear drivingly connectable to said propeller shaft and in mesh with said fourth bevel gear.

10. A marine propulsion device in accordance with claim 1 wherein said gear case assembly includes a gear segment having a center coincident with said steering axis, wherein said lower housing supports a lower steering shaft extending radially relative to said tilt axis and having upper and lower ends, a pinion fixed to said lower end of said lower steering shaft and in mesh with said gear segment, an upper steering shaft supported by said upper housing in radial relation to said tilt axis and having upper and lower ends, a universal coupling connecting said lower end of said upper steering shaft to said upper end of said lower steering shaft, and a lever fixed to said upper end of said upper steering shaft for pivotally displacing said upper shaft to effect steering movement of said gear case assembly.

11. A boat including a hull having a transom, and a marine propulsion device comprising a bracket fixed to said transom and including a horizontal opening, and a marine propulsion unit including an assembly extending through said opening and being fixed relative to said bracket, said assembly comprising a power head located above said bracket and including an internal combustion engine, a cover cooperating with said bracket to define a compartment enclosing said power head, and an upper housing located below said bracket, said marine propulsion unit also including a lower housing connected to said upper housing for pivotal movement therebetween about a horizontal tilt axis, a gear case assembly connected to said lower housing for pivotal movement therebetween about a steering axis transverse to said tilt axis, a propeller rotatably carried by said gear case assembly, a drive train connected to said propeller and said engine and extending through said gear case assembly and said lower and upper housings, and duct means extending through said transom and communicating with the interior of said compartment for supplying air to said power head.

12. A boat including a hull having a transom, and a marine propulsion device comprising a bracket fixed to said transom and including a horizontal opening, a marine propulsion unit including a fixed assembly extending through said opening, fixed relative to said bracket, and comprising a power head located above said bracket and including an internal combustion engine, and an upper housing located below said bracket, a lower housing connected to said upper housing for pivotal movement therebetween about a horizontal tilt axis, a gear case assembly connected to said lower housing for pivotal movement therebetween about a steering axis transverse to said tilt axis, a propeller rotatably carried by said gear case assembly, a drive train connected to said propeller and said engine and extending through said gear case assembly and said lower and upper housings, a cover cooperating with said bracket to define a compartment enclosing said power head, duct means extending though said transom and communicating with the interior of said compartment for supplying air to said power head, and propulsion unit control means extending through said duct into said compartment and connected to said propulsion unit for control thereof.

13. A marine propulsion installation comprising a boat hull including a transom, a propulsion device including a lower unit, means adapted to be connected to the transom for supporting said lower unit from the transom for vertical swinging movement about a horizontal axis, and a power head compartment which is located above said lower unit and aft of said transom, and which is substantially closed and has an interior housing an internal combustion engine located above said horizontal axis, and a duct extending through said transom and communicating between the atmosphere forwardly of said transom and the interior of said power head compartment.

14. A marine propulsion installation comprising a boat hull including a transom having therein an aperture, a propulsion device including a lower unit, means adapted to be connected to the transom for supporting said lower unit from the transom for vertical swinging movement about a horizontal axis, and a power head compartment which is located above said lower unit and aft of said transom, which is substantially closed and has an interior housing an internal combustion engine located above said horizontal axis, and which includes a forwardly located wall having therein an aperture, and a duct sealingly connected to said transom and to said forwardly located wall and including a hollow interior in communication through said opening in said transom with the atmosphere forwardly of said transom and communicating through said aperture to said forwardly located wall with said interior of said power head compartment.

* * * * *

UNITED STATES PATENT AND TRADEMARK OFFICE

CERTIFICATE OF CORRECTION

PATENT NO. : 4,371,348

DATED : February 1, 1983

INVENTOR(S) : Clarence E. Blanchard

It is certified that error appears in the above-identified patent and that said Letters Patent are hereby corrected as shown below:

Column 4, line 32, "94" should be -- 93 --.

Column 7, line 60, before "lower", insert -- said --.

Column 10, line 8,, "to" should be -- in --.

Signed and Sealed this

*Thirteenth* Day of *August 1985*

[SEAL]

*Attest:*

DONALD J. QUIGG

*Attesting Officer* *Acting Commissioner of Patents and Trademarks*